US010823381B1

(12) United States Patent
Wu et al.

(10) Patent No.: US 10,823,381 B1
(45) Date of Patent: Nov. 3, 2020

(54) FLASHLIGHT CAPABLE OF FUNCTIONING AS SELF-DEFENSE TOOL

(71) Applicants: Race Wu, Taichung (TW); Steve John Avila, Bellingham, WA (US)

(72) Inventors: Race Wu, Taichung (TW); Steve John Avila, Bellingham, WA (US)

( * ) Notice: Subject to any disclaimer, the term of this patent is extended or adjusted under 35 U.S.C. 154(b) by 0 days.

(21) Appl. No.: 16/695,724

(22) Filed: Nov. 26, 2019

(30) Foreign Application Priority Data

Aug. 27, 2019 (TW) ..... 108211343 A

(51) Int. Cl.
*F21V 21/40* (2006.01)
*F21V 33/00* (2006.01)
*F21V 23/04* (2006.01)

(52) U.S. Cl.
CPC ..... *F21V 21/406* (2013.01); *F21V 23/0421* (2013.01); *F21V 23/0428* (2013.01); *F21V 33/0076* (2013.01)

(58) Field of Classification Search
CPC ..... F21V 21/406; F21V 23/0421; F21V 23/0428; F21V 33/0076
See application file for complete search history.

(56) References Cited

U.S. PATENT DOCUMENTS 1,763,815 A * 6/1930 Pajeau ..... F21L 4/00 362/197
3,517,185 A * 6/1970 Bacevius ..... F21L 4/085 362/183
D226,908 S * 5/1973 Tadlock ..... D22/117
4,186,851 A * 2/1980 Cantor ..... F21V 33/0076 222/113
6,641,277 B2 11/2003 Smith
8,985,804 B2 3/2015 Frazier
2003/0058636 A1* 3/2003 Smith ..... F41G 1/36 362/111
2004/0184260 A1* 9/2004 Kukuk ..... F21V 33/0064 362/96
2006/0072306 A1* 4/2006 Woodyard ..... H01M 10/46 362/157
2013/0118767 A1* 5/2013 Cannaliato ..... B25F 5/021 173/29
2014/0000145 A1* 1/2014 Merritt ..... F41F 1/00 42/114
2019/0271528 A1* 9/2019 Nangunoori ..... G08B 15/02

* cited by examiner

*Primary Examiner* — Jong-Suk (James) Lee
*Assistant Examiner* — Christopher E Dunay
(74) *Attorney, Agent, or Firm* — Muncy, Geissler, Olds and Lowe, P.C.

(57) ABSTRACT

Provided is a flashlight including a casing, a power module and a light. An opening is disposed at the front end of the casing. A finger compartment penetrating two lateral surfaces of the casing is centrally disposed at the casing. The power module has a first light switch, a second light switch and a power. The first light switch is disposed in the finger compartment of the casing. The second light switch protrudes from the rear end of the casing. The power is disposed in the casing and electrically connected to the first and second light switches. The light is disposed in the opening and electrically connected to the first and second light switches, and one of which drives the light to turn on and turn off. A user can alter a grip and use both hands while illuminated, allowing the flashlight to function as a self-defense tool.

8 Claims, 9 Drawing Sheets

FLASHLIGHT CAPABLE OF FUNCTIONING AS SELF-DEFENSE TOOL

FIELD OF THE INVENTION

The present disclosure relates to flashlights and, more particularly, to a flashlight capable of functioning as a self-defense tool.

BACKGROUND OF THE INVENTION

U.S. Pat. No. 8,985,804 discloses a flashlight including a tubular body. A front end of the tubular body has a lamp assembly. The rear end of the tubular body has an opening adapted to accommodate a finger and a switch disposed at one end of the opening. A user's right hand holds a handgun and left hand grips the rear end of the tubular body. Then, the index finger is inserted into the opening to prevent the flashlight from falling off, whereas the thumb manipulates the switch to turn on the lamp assembly. However, the tubular body is not ergonomic, and in consequence gripping the tubular body for a long time may cause hand fatigue. Furthermore, to render the left hand available (for example, in order to perform a body search on a suspect for contraband), the user must stop using the flashlight first, albeit exposure to hazards, for lack of illumination.

U.S. Pat. No. 6,641,277 discloses a flashlight including a body. The body has a recess adapted to accommodate fingers. An off-auto-on switch is mounted on the top surface of the body. A watertight touch pad switch is mounted on an inner surface of the handle. Both the two switches control the lamp to turn on and turn off. When the flashlight operates in conjunction with a handgun, a user holds the handgun with his/her right hand and rests the gunstock on the top surface of the body for support. Next, the user inserts the left hand into the recess and squeezes the touch pad switch such that the lamp emits light in the direction aimed by the handgun. However, the body is not ergonomic, and in consequence gripping the body for a long time may cause hand fatigue. Furthermore, the flashlight falls off as soon as the left hand releases the handle. As a result, to render the left hand available, the user must stop using the flashlight first, albeit exposure to hazards, for lack of illumination.

BRIEF SUMMARY OF THE INVENTION

It is an objective of the present disclosure to provide a flashlight which not only enables a user to use both hands while illuminated, but also enables the user to vary a grip on the flashlight as needed, thereby allowing the flashlight to function as a self-defense tool.

In order to achieve the above and other objectives, the present disclosure provides a flashlight comprising a casing, a power module and a light. The casing has a cantilever portion and a grip portion. The front end of the cantilever portion has an opening. The grip portion extends arcuately from the rear end of the cantilever portion. The casing further has a finger compartment. The finger compartment is disposed at the junction of the cantilever portion and the grip portion and penetrates two opposing lateral surfaces of the casing. The power module has a first light switch, a second light switch and a power. The first light switch and the second light switch are disposed at the grip portion of the casing. The first light switch protrudes from the wall of the finger compartment. The second light switch protrudes from the rear end of the grip portion of the casing. The power is disposed in the grip portion of the casing and electrically connected to the first light switch and the second light switch. The light is disposed in the opening of the cantilever portion of the casing and electrically connected to the first light switch and the second light switch such that the light is driven by the first light switch or the second light switch to turn on and turn off.

Therefore, one or two fingers other than the thumb are inserted into the finger compartment such that the flashlight is entirely and continuously gripped by the hand and thereby is unlikely to fall off. Afterward, a user can alter the grip as needed and then selectively use the fingers in the finger compartment to trigger the first light switch to turn on the light or selectively use the thumb to trigger the second light switch to turn on the light such that the light provides continuous or intermittent illumination. To render both hands available, the user keeps the fingers in the finger compartment ready to trigger the first light switch such that the light provides continuous illumination, so as to increase the user's personal safety.

Preferably, the cantilever portion of the casing extends along a first axis, the grip portion of the casing extends along a second axis, an included angle is defined between the first axis and the second axis, and the included angle ranges from 120 degrees to 150 degrees, thereby rendering the casing ergonomic.

Preferably, the top surface of the grip portion of the casing arcuately extends and has an anti-slip pattern. As soon as the fingers press against the anti-slip pattern, the anti-slip pattern performs an anti-slip function and facilitates a grip.

Preferably, the bottom surface of the casing has an arch portion. The arch portion extends from the bottom surface of the cantilever portion, along the outline of the finger compartment, and to the bottom surface of the grip portion, so as to not only protect the first light switch, but also allow the user to hit an attacker with the arch portion.

Preferably, the casing further has a solenoid portion which extends outward from the rim of the opening of the cantilever portion. The solenoid portion is mounted on a connector by means of screwing, allowing the user to perform self-defense with the connector.

Preferably, the bottom surface of the grip portion of the casing has a recess adapted to accommodate fingers so as to facilitate a grip.

Preferably, a glass breaker positioned proximate to the second light switch is disposed at the rear end of the grip portion of the casing, allowing the user to break building windows or car window with the glass breaker.

Fine structures, features, assembly or operation of the flashlight of the present disclosure are illustrated by embodiments and described below. However, persons skilled in the art understand that the description below and the specific embodiments are illustrative of the present disclosure rather than restrictive of the claims of the present disclosure.

DETAILED DESCRIPTION OF THE PREFERRED EMBODIMENTS

Figure 1:
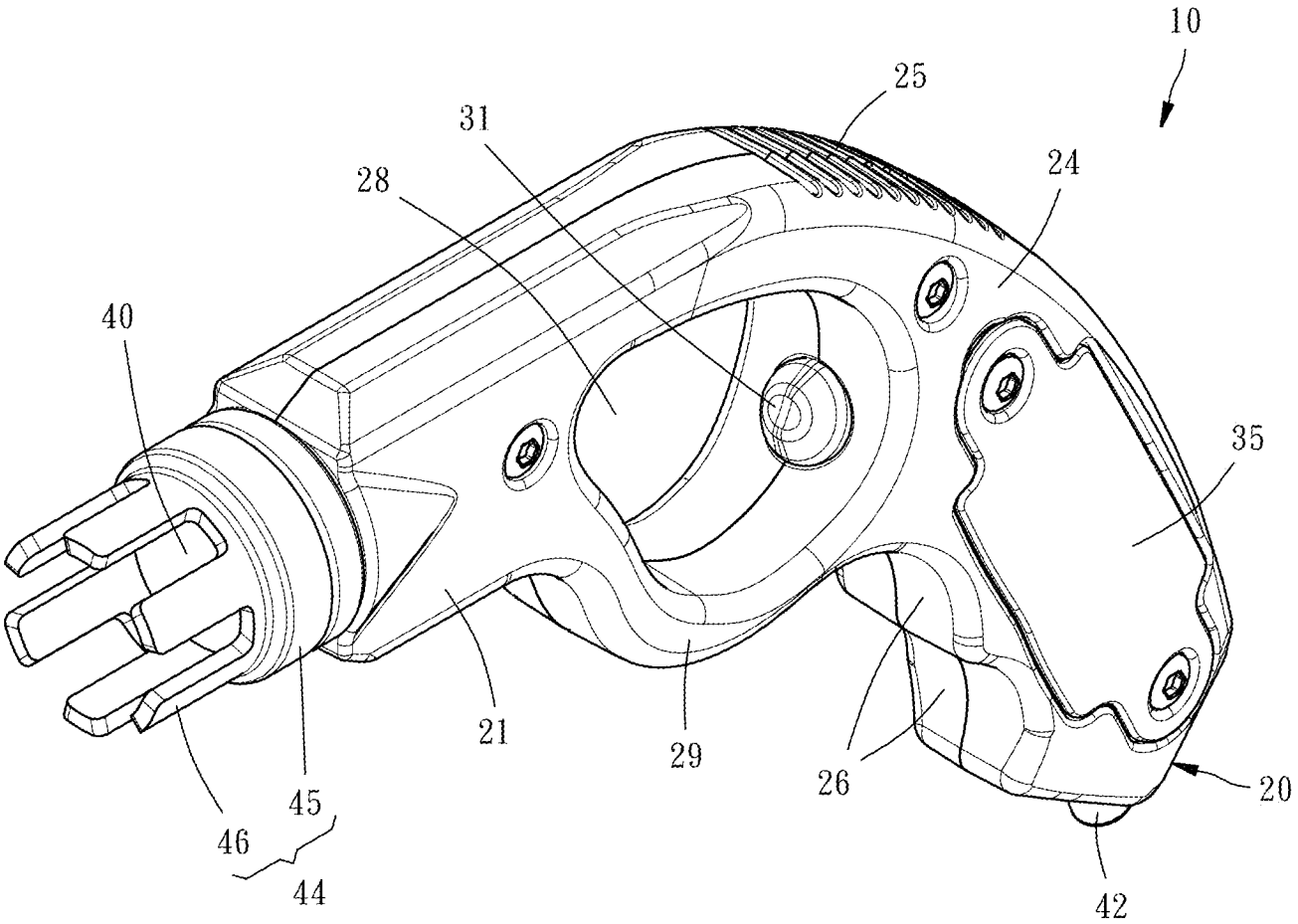
FIG. 1 is a perspective view of a flashlight of the present disclosure.

Directional expressions used herein, including the description of embodiments and claims, must be interpreted in accordance with the accompanying drawings. Identical reference numerals used in the embodiments and the accompanying drawings denote identical or similar components or structural features thereof.

Figure 2:
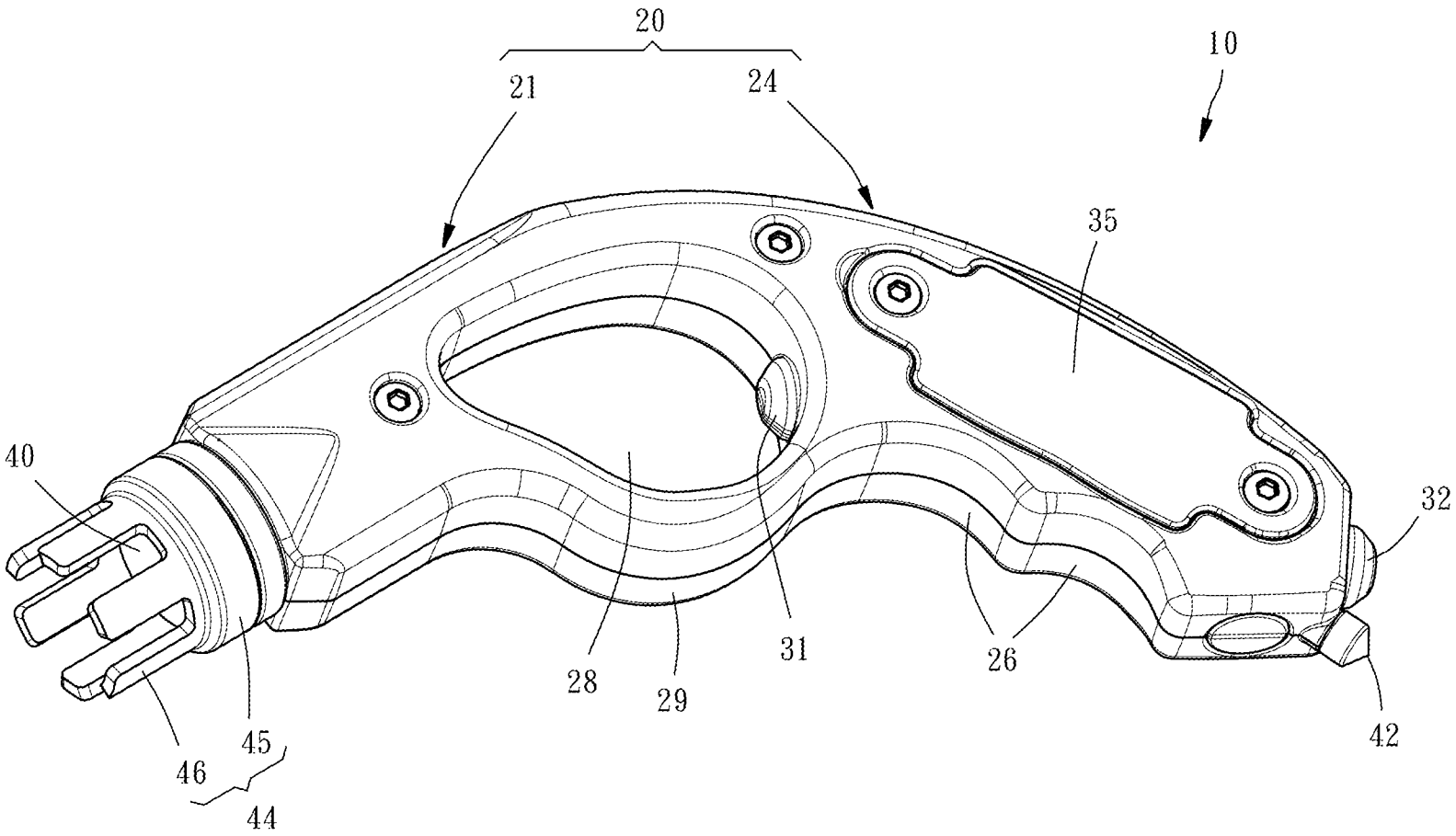
FIG. 2 is a perspective view of the flashlight of the present disclosure from another angle.
Figure 3:
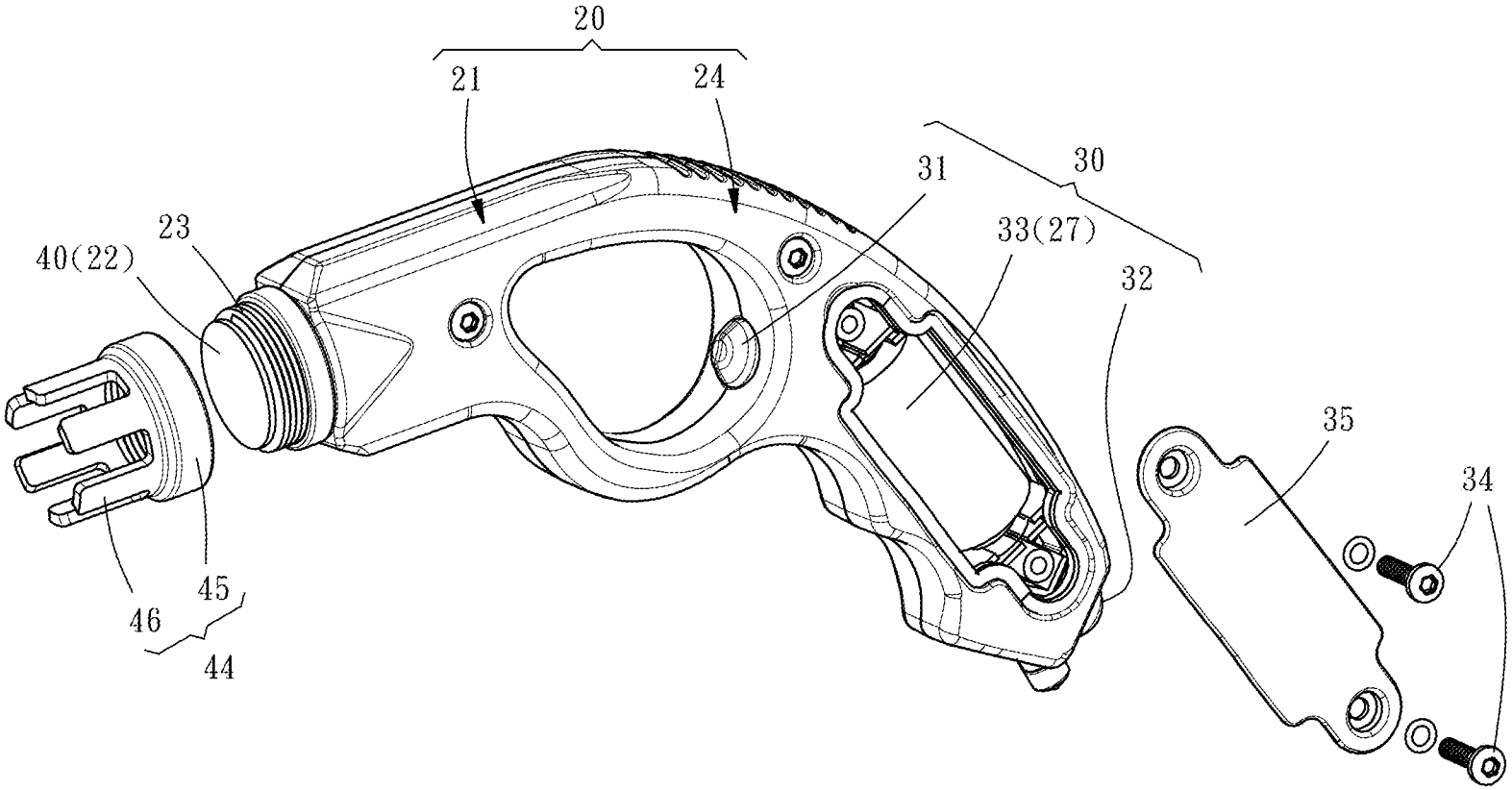
FIG. 3 is a partial exploded view of the flashlight of the present disclosure.

Referring to FIG. 1 through FIG. 3, a flashlight 10 of the present disclosure comprises a casing 20, a power module 30, and a light 40.

Figure 4:
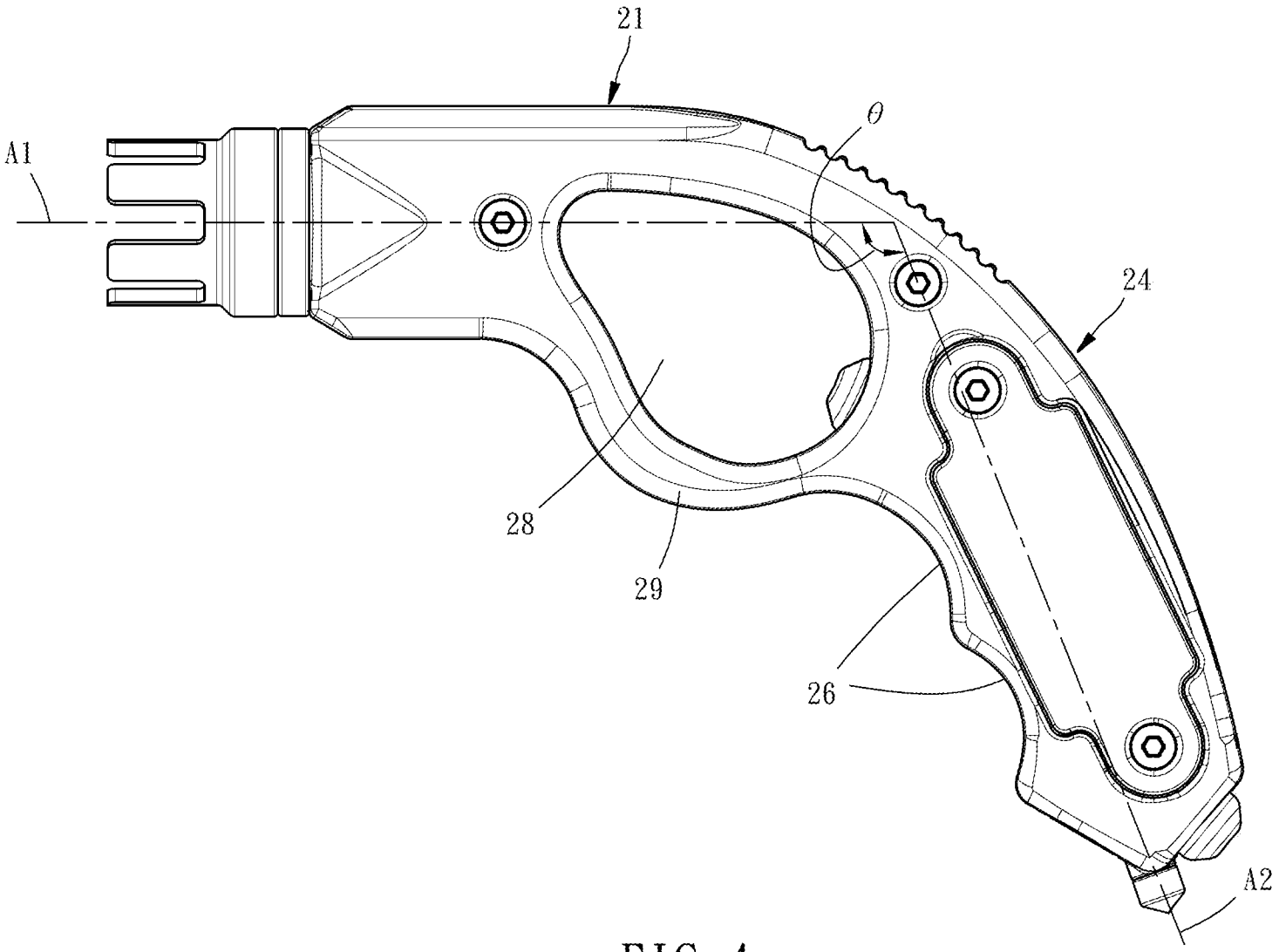
FIG. 4 is a lateral view of the flashlight of the present disclosure.

The casing 20 has a cantilever portion 21 and a grip portion 24. The front end of the cantilever portion 21 has an opening 22 and a solenoid portion 23 extending outward from the rim of the opening 22. The grip portion 24 extends accurately from the rear end of the cantilever portion 21. The top surface of the grip portion 24 has an anti-slip pattern 25. The bottom surface of the grip portion 24 has two arcuate recesses 26 adapted to accommodate fingers. The left lateral surface of the grip portion 24 has a battery chamber 27. Furthermore, the casing 20 further has a finger compartment 28 which fingers are penetratingly disposed at. The finger compartment 28 has a droplet-shaped cross-section which may be any shape for retention and holding options. The finger compartment 28 is disposed at the junction of the cantilever portion 21 and the grip portion 24 and penetrates two opposing lateral surfaces of the casing 20. The bottom surface of the casing 20 has an arch portion 29. The arch portion 29 extends from the bottom surface of the cantilever portion 21, along the outline of the finger compartment 28, and to the bottom surface of the grip portion 24. As shown in FIG. 4, the cantilever portion 21 extends along a first axis A1, whereas the grip portion 24 extends along a second axis A2, and an included angle θ is defined between the first axis A1 and the second axis A2. The included angle θ ranges from 120 degrees to 150 degrees, preferably 135 degrees, so as to render the flashlight 10 ergonomic.

The power module 30 has a first light switch 31, a second light switch 32 and a power 33 (exemplified by a battery). The first light switch 31 is disposed at the front end of the grip portion 24 of the casing 20 and protrudes from the wall of the finger compartment 28. The second light switch 32 is disposed at the rear end of the grip portion 24 of the casing 20 and protrudes from the casing 20. The power 33 is disposed in the battery chamber 27 of the grip portion 24 of the casing 20 and covered with a cover 35 fastened to the grip portion 24 of the casing 20 by two screws 34. Furthermore, the power 33 is electrically connected to the first light switch 31 and second light switch 32 by wires, for example, and adapted to supply electrical power to the first light switch 31 and second light switch 32.

The light 40 (exemplified by a light-emitting diode) with a lens are disposed in the opening 22 of the cantilever portion 21 of the casing 20 and electrically connected to the first light switch 31 and second light switch 32 by wires, for example, such that the light 40 is driven by one of the first light switch 31 and second light switch 32 to turn on and turn off.

Figure 5:
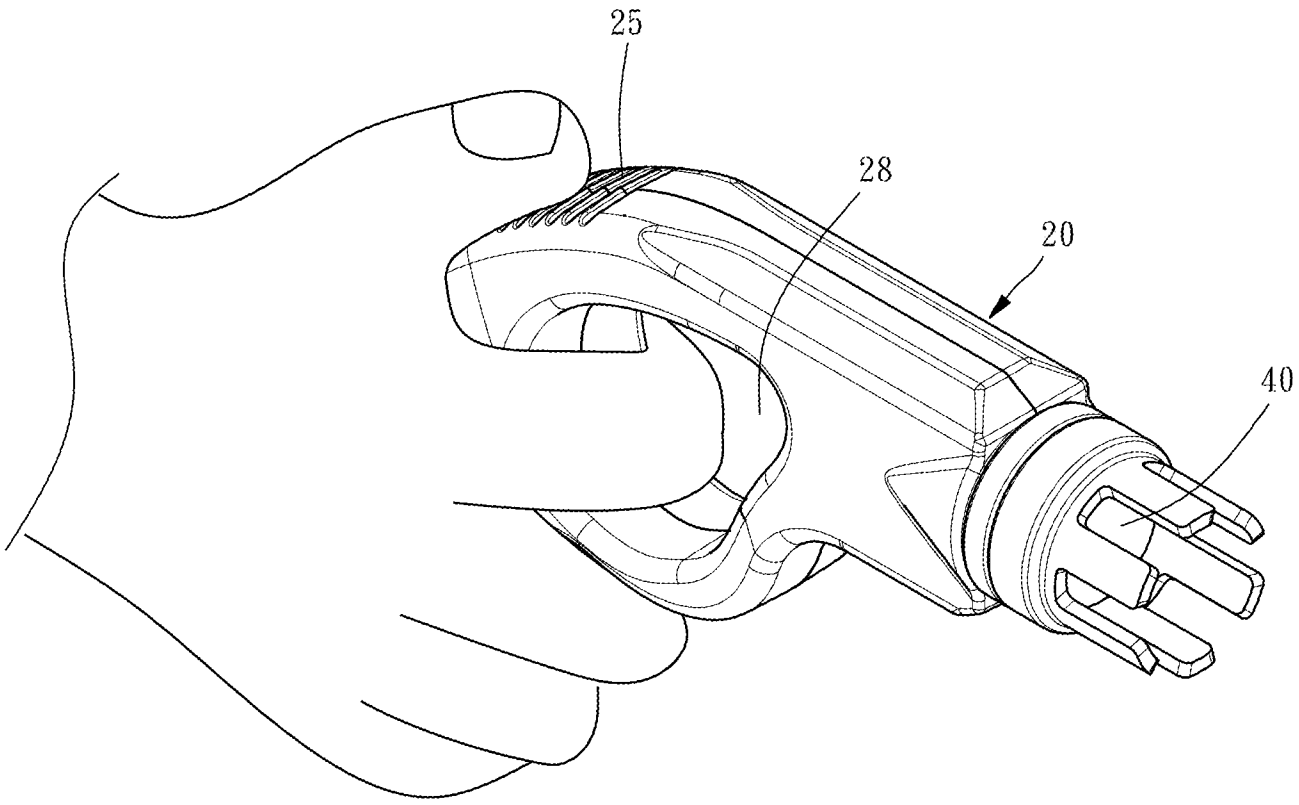
FIG. 5 is a schematic view of the flashlight operating according to the present disclosure, showing that the flashlight is gripped by the right hand.

In practice, the flashlight 10 of the present disclosure allows a user to select a grip mode suitable for himself or herself. For example, as shown in FIG. 5, the user uses the right palm to grip the grip portion 24 of the casing 20 such that the light 40 faces forward, and then the user has the index finger inserted into the finger compartment 28 and pressed against the first light switch 31 so as to be ready to turn on or turn off the light 40 at any time. At this point in time, the thumb presses against the anti-slip pattern 25 to facilitate the grip. Then, the middle finger and ring finger are inserted into the two recesses 26. The little finger presses against the bottom end of the grip portion 24 of the casing 20. Therefore, the index finger presses against the first light switch 31 to cause the light 40 to provide continuous or intermittent illumination.

Figure 6:
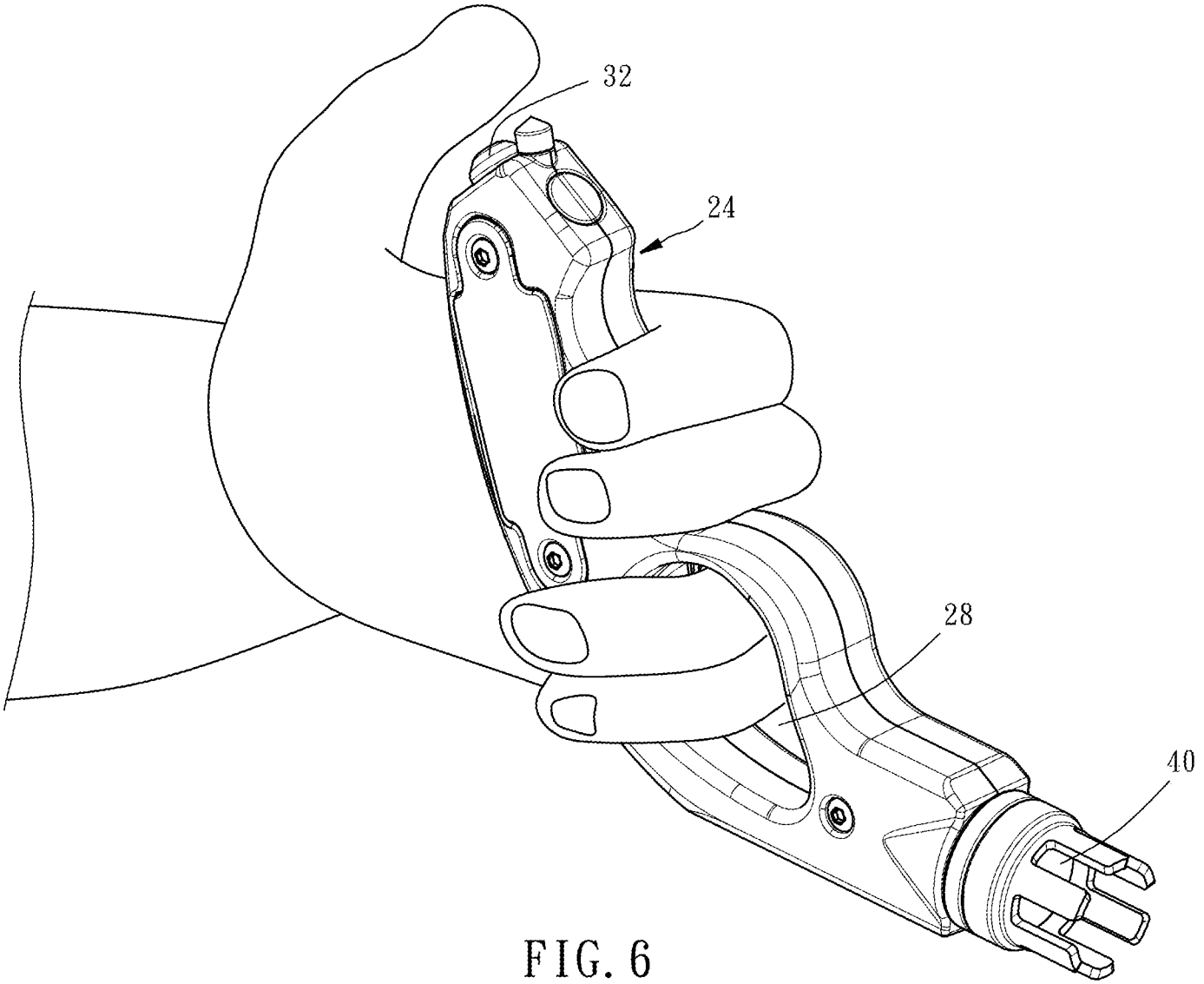
FIG. 6 is a schematic view of the flashlight operating according to the present disclosure, showing that the flashlight is gripped by the left hand.
Figure 7A:
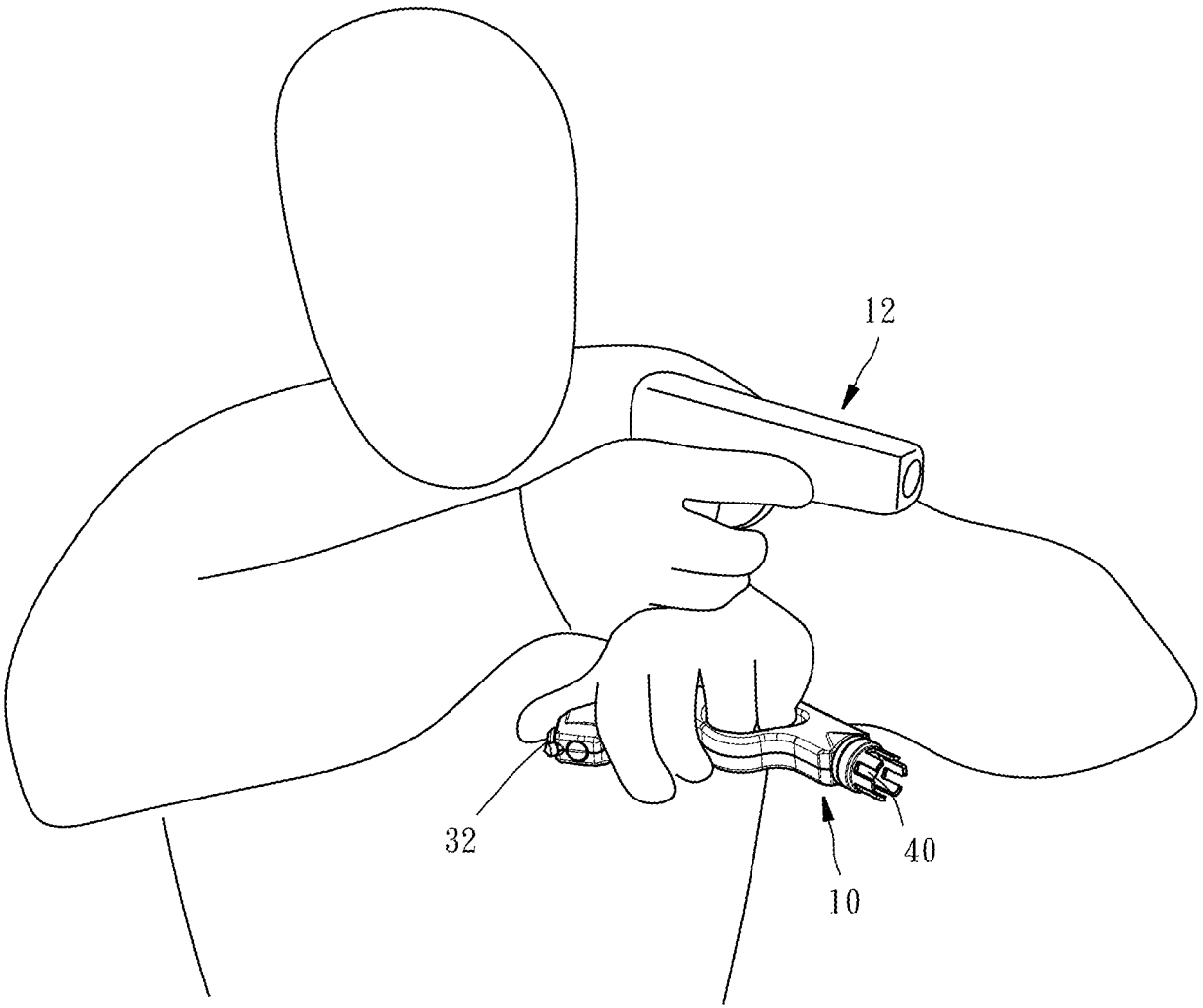
FIG. 7A to FIG. 7B are schematic views of the flashlight operating according to the present disclosure, showing that a self-defense weapon is gripped by the right hand.
Figure 7B:
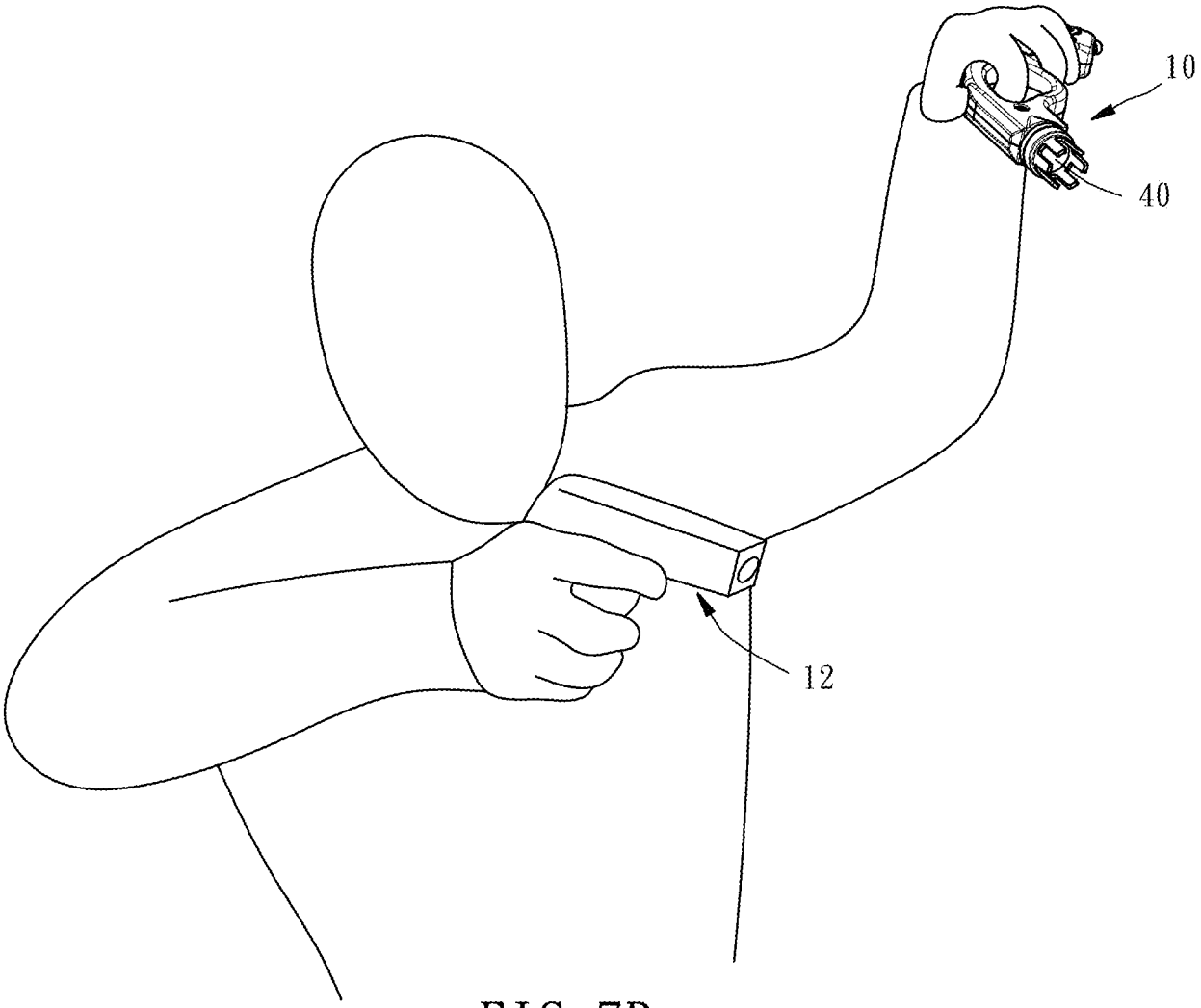

In addition to the aforesaid way of holding the flashlight 10 (as shown in FIG. 7A), the user can hold a self-defense weapon 12, such as a handgun, a stun gun or a baton, by the right hand and hold the flashlight 10 by the left hand by gripping the flashlight 10 upside down (as shown in FIG. 7B). As shown in FIG. 6, the user uses the left palm to grip the grip portion 24 of the casing 20 such that the light 40 faces forward, and then the user inserts the ring finger and little finger into the finger compartment 28 to prevent the flashlight 10 from falling off. After that, the user inserts the index finger and middle finger into the two recesses 26: meanwhile, the thumb is aligned with the second light switch 32. Therefore, the thumb can press the second light switch 32 to cause the light 40 to provide continuous or intermittent illumination. Afterward, the user grips the self-defense weapon 12 by the right hand to scare a suspect and carry out self-defense.

Figure 8:
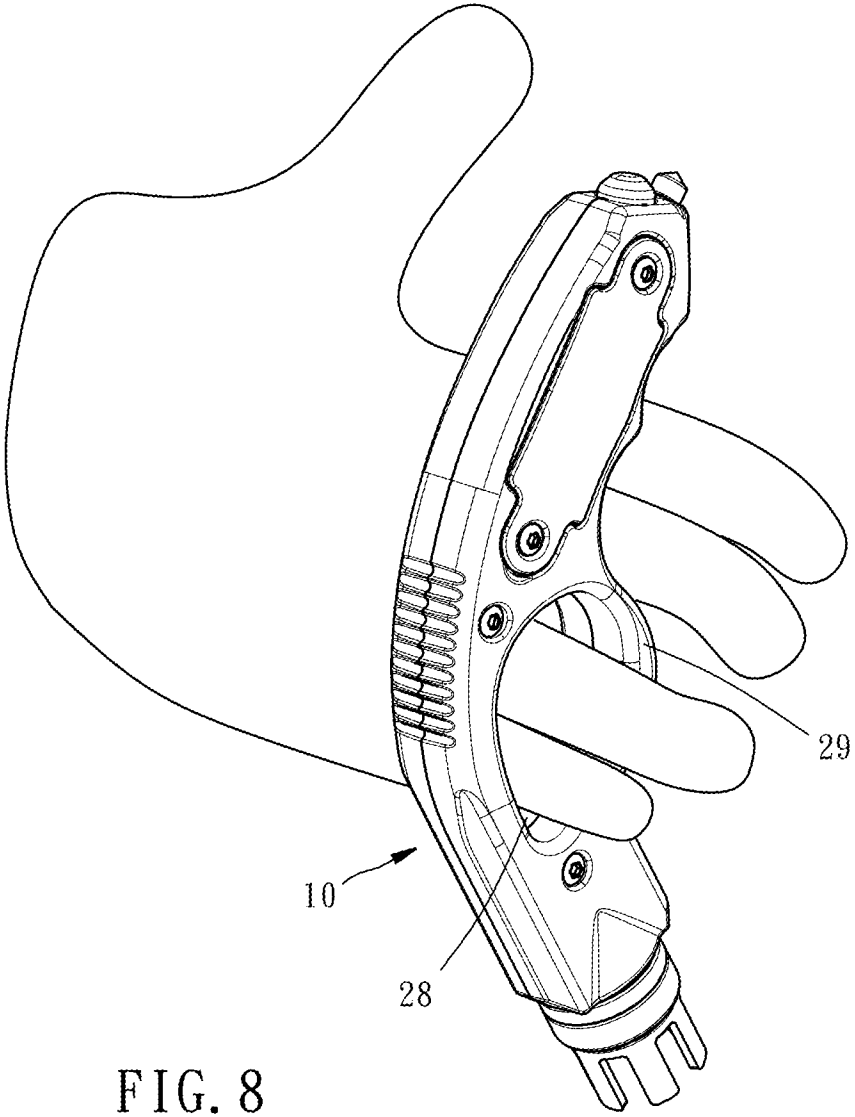
FIG. 8 is a schematic view of the flashlight operating according to the present disclosure, showing that the palm releases the flashlight.

As shown in FIG. 8, to use both hands (for example, in order to perform a body search on the suspect for contraband) while the light 40 is on, the user has any two fingers inserted into the finger compartment 28 and attached to the arch portion 29. Therefore, not only are the fingers in the finger compartment 28 kept triggering the first light switch 31 such that the light 40 provides continuous illumination, but the user can also keep gripping the flashlight 10 by hand because of the fingers attached to the arch portion 29. Therefore, the user can use both hands while illuminated, thereby increasing personal safety.

The flashlight 10 of the present disclosure further comprises a glass breaker 42 and a connector 44. As shown in FIG. 2, the glass breaker 42 is fixedly disposed at the rear end of the grip portion 24 of the casing 20 and positioned proximate to the second light switch 32. As shown in FIG. 1 and FIG. 3, the connector 44 has a threaded ring 45 and fork rods 46. The fork rods 46 extend outward from an end surface of the threaded ring 45. The fork rods 46 are arranged annularly relative to the center of the threaded ring 45 and spaced apart. The threaded ring 45 of the connector 44 is removably fastened to the solenoid portion 23 of the casing 20 and this will be a two piece ring to allow user to change design on the front and also lens color. Therefore, in case of emergency, for example, when people are trapped in a building or car, the user can break windows of the building or car with the glass breaker 42 to rescue the otherwise trapped people. In a violent scenario, for example, in the face of an attacker, the user can hit the attacker's head or any vulnerable part of the attacker's body with the fork rods 46 of the connector 44 or the arch portion 29 of the casing 20, so as to scare the attacker off.

In conclusion, the flashlight 10 of the present disclosure not only enables the user to use both hands at will while illuminated, but also enables the user to vary a grip on the flashlight as needed, thereby allowing the flashlight to function as a self-defense tool. Therefore, the flashlight demonstrates enhanced ease of use and practicability.

What is claimed is:

1. A flashlight, comprising:

a casing having a cantilever portion and a grip portion, with an opening disposed at a front end of the cantilever portion, the grip portion accurately extending from a rear end of the cantilever portion, the casing further having a finger compartment, with the finger compartment disposed at a junction of the cantilever portion and the grip portion and penetrating two opposing lateral surfaces of the casing;

a power module having a first light switch, a second light switch and a power, the first and second light switches being disposed at the grip portion of the casing, the first light switch protruding from a wall of the finger compartment, the second light switch protruding from a rear end of the grip portion of the casing, with the power disposed in the grip portion of the casing and electrically connected to the first light switch and the second light switch; and a light disposed in the opening of the cantilever portion of the casing and electrically connected to the first light switch and the second light switch such that the light is driven by the first light switch or the second light switch to turn on and turn off;

wherein a top surface of the grip portion of the casing has an anti-slip pattern located at an outer convex portion of the grip portion of the casing;

wherein the finger compartment has a droplet-shaped cross-section having a gradually narrowed portion adjacent to the cantilever portion, and a pressing axis of the first light switch is aimed at the gradually narrowed portion.

2. The flashlight of claim 1, wherein the cantilever portion of the casing extends along a first axis, the grip portion of the casing extends along a second axis, an included angle is defined between the first axis and the second axis, and the included angle ranges from 120 degrees to 150 degrees.

3. The flashlight of claim 2, wherein the included angle is 135 degrees.

4. The flashlight of claim 1, wherein the bottom surface of the casing has an arch portion which extends from the bottom surface of the cantilever portion, along an outline of the finger compartment, and to the bottom surface of the grip portion.

5. The flashlight of claim 1, wherein the casing further has a solenoid portion which extends outward from a rim of the opening of the cantilever portion.

6. The flashlight of claim 5, further comprising a connector with a threaded ring and fork rods, with the threaded ring fastened to the solenoid portion of the casing, with the fork rods extending outward from an end surface of the threaded ring and arranged annularly relative to the center of the threaded ring and spaced apart.

7. The flashlight of claim 1, wherein a bottom surface of the grip portion of the casing has a recess adapted to accommodate a finger.

8. The flashlight of claim 1, further comprising a glass breaker fixedly disposed at the rear end of the grip portion of the casing and positioned proximate to the second light switch.

* * * * *